US005713271A

United States Patent [19]

De Brock

[11] Patent Number: 5,713,271

[45] Date of Patent: *Feb. 3, 1998

[54] METHOD OF AND ARRANGEMENT FOR APPLYING A SURFACE PRESSURE TO WORKPIECES DRIVEN BY A PRESSING BAND

[75] Inventor: Raoul De Brock, Kortrijk, Belgium

[73] Assignee: Firma Theodor Hymmen, Bielefeld, Germany

[ * ] Notice: The term of this patent shall not extend beyond the expiration date of Pat. No. 5,558,016.

[21] Appl. No.: 609,856

[22] Filed: Mar. 1, 1996

Related U.S. Application Data

[63] Continuation of Ser. No. 206,337, Jun. 10, 1988, Pat. No. 5,558,016.

[30] Foreign Application Priority Data

Jun. 15, 1987 [DE] Germany ..... 37 19 976.5

[51] Int. Cl.[6] ..... B30B 15/34

[52] U.S. Cl. ..... 100/93 P; 100/151; 156/583.5; 425/371

[58] Field of Search ..... 100/35, 38, 92, 100/93 P, 93 RP, 151, 152, 153, 154; 156/583.5; 425/371

[56] References Cited

U.S. PATENT DOCUMENTS

| | | | |
|---|---|---|---|
| 2,135,763 | 11/1938 | Nicholson | 100/151 |
| 3,734,669 | 5/1973 | Ettel | 100/93 RP |
| 3,992,135 | 11/1976 | Camp, III | 425/371 |
| 4,420,359 | 12/1983 | Goldsworthy | 100/151 |
| 4,541,889 | 9/1985 | Held | 100/93 RP |

*Primary Examiner*—Tony G. Soohoo
*Attorney, Agent, or Firm*—Michael J. Striker

[57] ABSTRACT

For applying a surface pressure and temperature to pressing band-driven workpieces a fluid pressure medium is accommodated in a pressure chamber which is limited between a pressing band and a workpiece as well as seals located therebetween, and the fluid pressure medium is subjected to extensive forced movement in the pressure chamber which forms an action zone.

14 Claims, 2 Drawing Sheets

METHOD OF AND ARRANGEMENT FOR APPLYING A SURFACE PRESSURE TO WORKPIECES DRIVEN BY A PRESSING BAND

This is a continuation of application Ser. No. 07/206,337 filed Jun. 10, 1988 now U.S. Pat. No. 5,558,016.

BACKGROUND OF THE INVENTION

The present invention relates to a method of and arrangement for applying a surface pressure to workpieces which are driven by a pressing band, for example, continuously movable material webs, also in form of laminates or the like.

Methods and arrangements of the above-mentioned general type are known in the art. One of such methods and arrangements is disclosed in the German document DE-OS 24 21 296. In this reference the surface pressure is applied in an action zone which it limited at its one side by the pressing band, under the action of the pressure of a gaseous or liquid pressure medium acting in the action zone. A pressure chamber can be limited by a peripherally closed substantially rectangular seal over the periphery of the pressure chamber. At its one side, the pressure chamber is limited by a rotatable pressing band, while at its rear side it is limited by a pressing plate which simultaneously forms a heating plate for heating the pressure medium in the action zone. Band presses which are provided with such pressure chambers, for example, double-band presses, are also used for heating and/or cooling of the movable workpieces.

When the fluid pressure media used here are for example air or oil, controllability and sensitivity of adjustment are especially suitable. However, a problem remains in that the pressure gas layer which is located in the action zone between the rear side of the hot plate and the endless pressing band in the pressure chamber acts in an insulating manner with respect to the heat transfer. It has been proposed in the above-mentioned German document to replace strongly insulating gaseous pressure media with a liquid pressure medium, especially oil or liquid metal. While liquid metals for this goal and in this area of application technically cannot be considered as controllable, the use of oil does not bring radical improvements since the heat conductivity of oil is maximum three times the heat conductivity of air, and moreover it is susceptible to considerable contamination problems.

It has been also proposed to operate with heat bridges so as to insure a direct heat conduction from the heating plate to the endless pressing band through pressing shoes. This approach is disclosed in the German document DE-PS 33 25 578. The pressing shoes which provide the heat conduction have however considerable disadvantages. In addition to the very high force requirement for driving the pressing band, metal wear also occurs on the pressing shoes and therefore a reliable operation of the peripherally closed seals for the pressure chamber becomes questionable.

Finally, another system has been proposed, in which a pressure medium is no longer heated in the action zone but instead a steam (U.S. Pat. No. 2,135,763) or hot water (German document DE-OS 19 53 816) are supplied to the action zone in a circulation circuit. The heating is performed outside of the action zone, and the system operates with conventional supply speeds or withdrawal speeds for steam and hot water. These systems have to be considered as not suitable in praxis, since naturally the supplied hot pressure medium is cooled during its movement through the action zone. Since such action zones are relatively long, an unacceptable temperature drop in transporting direction of the workpiece is produced from the inlet to the outlet of the arrangement.

SUMMARY OF THE INVENTION

Accordingly, it is an object of the present invention to provide a method of and an arrangement for applying a surface pressure to workpieces driven by a pressing band, which avoids the disadvantages of the prior art.

More particularly, it is an object of the present invention to provide a method of and an arrangement for applying a surface pressure to workpieces which are driven by a pressing band, in which the heat transfer in the action zone between a pressing plate which is formed as a heating or cooling plate, and the pressing band is considerably improved.

In keeping with these objects and with others which will become apparent hereinafter, one feature of the present invention resides, briefly stated, in a method in which a fluid pressure medium in an action zone is extensively forcedly moved by respective moving means.

It has been determined completely unexpectedly that by the relatively extensive forced movement of the fluid medium under pressure in the action zone, its property to transfer heat to the pressing band is extraordinarily increased to such a degree that the heat transfer is much better than for example when the above-mentioned known pressing shoes are used. By the extensive forced movement in the action zone, the fluid medium which is under the operational pressure takes over the function of a heat transferring element from the heating plate which limits the action zone, as a sender to the pressing band. It is to be understood that exactly in the same way an extraordinarily improved cooling is produced when the pressing plate is formed as a cooling plate. In this case the heat flow propagates in an opposite direction from the pressing band.

In this system in which the heat transmitter and the heat receiver limit the action zone, a temperature drop occurs exclusively in direction from the heat transmitter to the heat receiver. The pressure medium acts only as an agent or as an intermediate layer with a very high heat transfer value resulting from the forced movement.

This also results in that the friction losses produced during the extensive forced movement are completely converted into heat and contribute to heating in the case of the heat transfer. In certain cases the heat transmitter can be completely switched off at least temporarily.

In the inventive system the speed of the forced movement of the medium can be used as a control value which allows very simple and very sensitive controlling of the heat transfer. The respective given operational pressure and the speed of transportation of the workpiece can be used as parameters. It should be mentioned that in the event of operational failures or product ends, the transmitting heat quantity drops abruptly, since in this case by interruption of the forced movement and switching off of respective heating, the medium in its immovable condition acts as an insulation layer between the heating plate and the pressing band in the action zone. It has been shown that this results only in a very low inertia and particularly in no delays in the heat energy transmission.

The degree of the forced movement depends on operational pressure and the degree of the desired heat transfer. In any case, it is desirable to move the medium so extensively that a turbulent movement of the pressure medium is produced. For gaseous media the movement speeds can be between 10 and 50 m/sec., preferably between 20 and 40 m/sec., while for liquid media the movement speeds can be between 2 and 5 m/sec., preferably between 4 and 5 m/sec.

The extensive forced movement can be produced either exclusively in the action zone, or in a circulating circuit which includes the action zone.

The devices for producing the extensive forced movement can include a fan which can be integrated in the pressing and heating plate, several fans with propellers extending into the pressure chamber, a rotary piston blower, or a condenser.

The pressure chamber can be provided with a zone which has a smaller flow cross-section as compared with a remaining part of the pressure chamber, for increasing the speed of the pressure medium in the pressure chamber.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
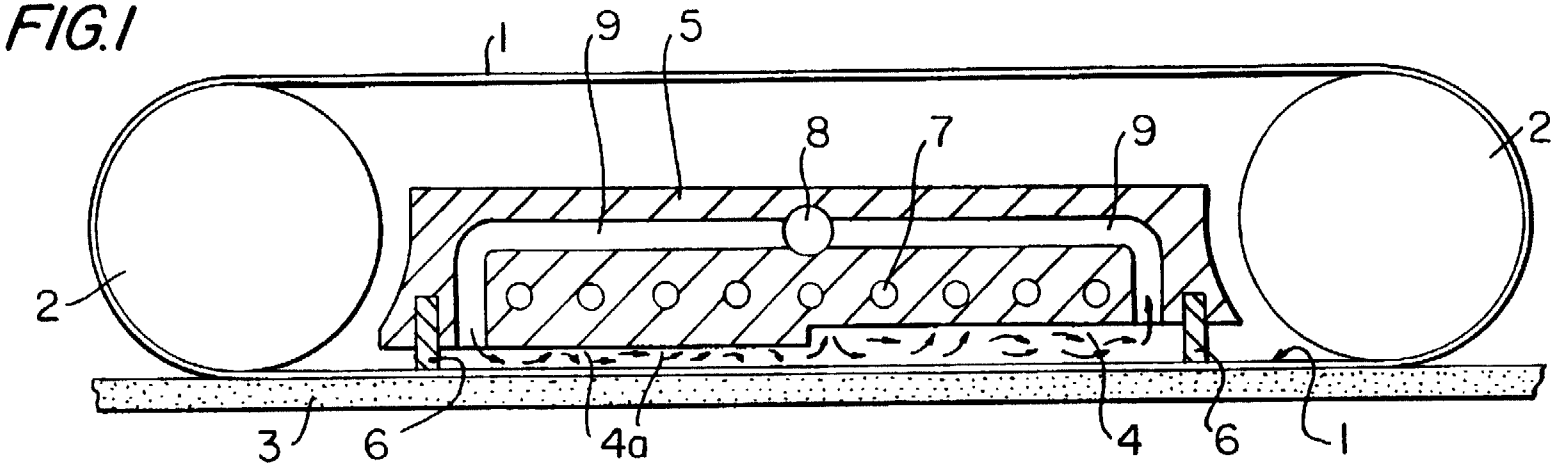
FIG. 1 is a view schematically showing an arrangement for applying a surface pressure to a workpiece which is driven by a pressing band, in accordance with the present invention.

An arrangement for applying a surface pressure as well as heat to pressing band-driven workpieces has a rotatable pressing band 1 which is conventionally composed of steel and runs over deviating rollers 2. The pressing band 1 continuously moves workpieces such as, for example, material webs also in form of laminates, along an action zone 4 which in the embodiment shown in FIG. 1 is formed as a pressure chamber. The pressure chamber is limited by the pressing band 1 at its one side, by a pressing and heating plate 5 at its opposite side, and also known peripherally closed or circular special seals 6.

In the action zone 4 or the pressure chamber, the required surface pressure is produced in a known manner, for example, by a gaseous pressure medium which is under the operational pressure. The pressure chamber is in communication with a not shown compressor in a conventional manner, which operates so as to continuously compensate leakage losses from the pressure chamber. A heating device 7 is located in the pressing and heating plate 5. In addition, a gaseous medium which is located in the action zone under pressure is subjected to an extensive forced movement by means of a gas displacing device. In the shown embodiment, the pressing and heating plate 5 has relatively great dimensions, and a fan 8 which forms the above-mentioned gas displacing device is integrated in it. The fan 8 communicates via an integrated pressure and suction conduit 9 with the action zone 4 and forcedly displaces the pressure medium which is accommodated under pressure in the action zone 4 in a very efficient manner. In particular, the forced displacement of the gaseous medium can be performed so that a turbulent flow is produced in the action zone 4 and leads to an extremely high heat transfer between the pressing and heating plate 5 and the pressing band 2.

The degree of the heat transfer can be controlled both by the operational pressure and especially by the flow speed in a very sensitive manner. In the embodiment shown in FIG. 1 it is achieved in very simple manner with the following approach. A stronger heating in a first portion of the action zone 4, as considered in direction of transportation of the workpiece 3, is produced as compared with a rear portion of the action zone 4 of the pressure chamber. This is achieved by a projecting shoulder which is formed in the pressing and heating plate 5 so that the first portion of the action zone 4 identified with reference 4*a* has a narrower cross-section and therefore a higher flow speed of the gaseous medium which passes therethrough.

Figure 2:
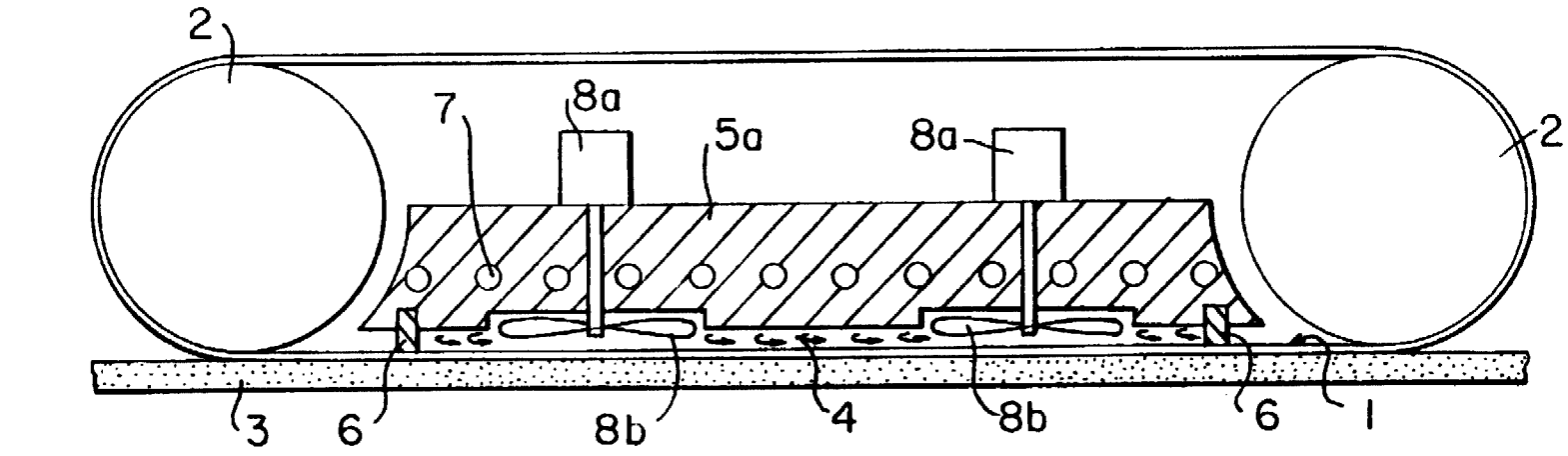
FIG. 2 is a schematic view showing the arrangement for applying a surface pressure in accordance with another embodiment of the present invention.

In the embodiment shown in FIG. 2 which actually has the same construction as the embodiment of FIG. 1, a pressing and heating plate 5*a* is provided with one or more gas displacement devices depending on the length of the action zone 4. In the embodiment of FIG. 2 there are two such gas displacement devices which are formed as fans 8*a* with rotatable propellers 8*b*. The propeller 8*b* is formed as a flat propeller and at least partially extends into the action zone 4.

The arrangements for applying surface pressure in accordance with FIGS. 1 and 2 have a compact construction which are characterized by very low heat losses and avoid previously existing connection problems.

Figure 3:
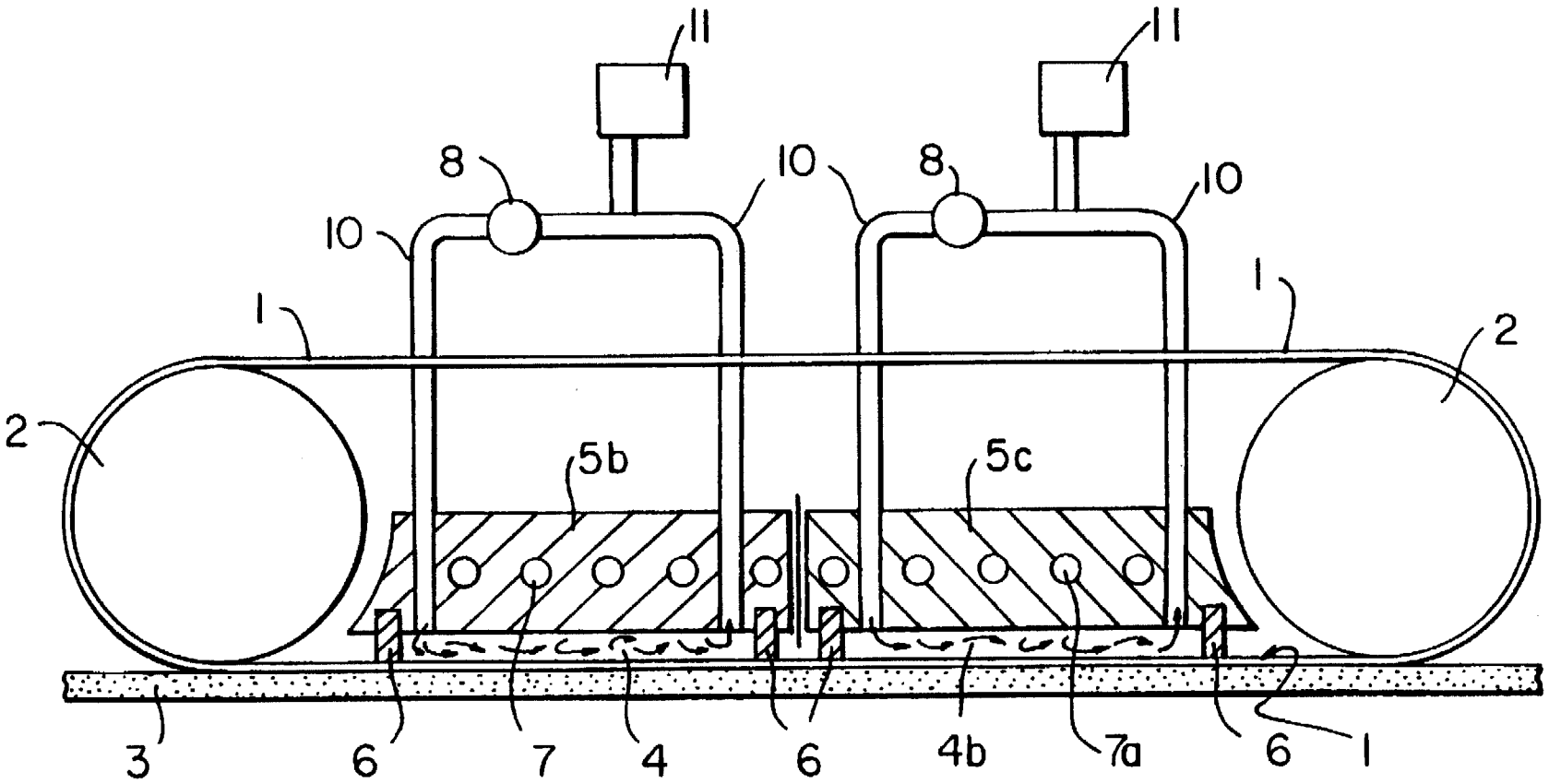
FIG. 3 is a view schematically showing the arrangement for applying the surface pressure in accordance with a further embodiment of the present invention.

The arrangement shown in FIG. 3 has the same basic structure as in the previous embodiments. It comprises a front pressing and heating plate 5*b* with supply and withdrawal conduits 10 which extend from the action zone 4 under the pressing and heating plate 5*b* outwardly of the plate. A fan 8 is arranged in the conduit 10, and further a compressor 11 is connected with the conduit 10 for continuously compensating leakage losses. The gaseous medium under the operational pressure is also directly heated here in the action zone 4, and its extensive forced movement in this action zone 4 serves for extraordinary increase of the heat transfer properties.

In the embodiment of FIG. 3 an action zone 4*b* is arranged after the action zone 4 which serves for heating the pressing band 1 and thereby the workpiece 3. The action zone 4*b* has basically the same construction as the action zone 4, however here the heat transfer direction is reversed. In other words, the action zone 4*b* is a cooling zone which has a pressing and cooling plate 5*c* provided with a cooling device 7*a*. In exactly the same manner, for considerable increase in the cooling properties, the gaseous medium which is under pressure in the action zone 4*a* is extensively displaced. This is performed by a fan 8. Also a compressor 11 is provided in this action zone. A rotary piston blower or a condensor can also be used as forced displacement devices. When the arrangement operates with liquid pressure media, pumps can be used instead of the fans described hereinabove.

In accordance with the inventive method for applying a surface pressure and transferring heat to the pressing band-driven workpieces, the surface pressure is produced in the sealed action zone by the pressure of a fluid pressure medium and in the action zone is heated or cooled in a conventional manner, and in addition the pressure medium which is under operational pressure is extensively forcedly displaced in the action zone. In accordance with the advantageous embodiment, the forced movement is performed so extensively that the pressure medium which is accommodated in the action zone under the operational pressure forms turbulent flows. Flow speeds of the media used in the inventive arrangement are approximately 20–40 m/sec. for gaseous pressure media and 4–5 m/sec. for liquid pressure medium. These speeds are especially advantageous for the operation of the inventive arrangement. The extensive forced movement can be performed locally, exclusively in the action zone. On the other hand, it is possible to provide a forced circulation in a closed circuit which includes the action zone.

The degree of the heat transfer can be controlled in a very sensitive manner by changing the flow speed and/or the pressure of the pressure medium in the action zone.

The forced movement of the gaseous pressure medium can be performed with the speed of 2–50 m/sec, preferably from 20–40 m/sec in the case of gaseous pressure medium and from 4–5 m/sec, in the case of liquid pressure.

This extensive forced movement of the fluid pressure medium is finished when the pressing band is stopped.

For obtaining the results produced by the present invention it is not necessary to guide the pressure medium in a closed circuit. It is possible to provide in the region of the seals which peripherally limit the pressure chamber, an increased loss of gaseous pressure medium and to considerably replace the pressure medium flowing out of the pressure chamber by supplying a corresponding quantity of pressure medium into the pressure chamber.

It will be understood that each of the elements described above, or two or more together, may also find a useful application in other types of constructions differing from the types described above.

While the invention has been illustrated and described as embodied in an arrangement for applying a surface pressure and heat to pressing band-driven workpieces, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of applying a surface pressure and a temperature to workpieces which are driven by a pressing band, comprising the steps of accommodating a fluid pressure medium in an action zone which is limited between a heating plate and a pressing band; producing a pressure in the fluid pressure medium in the action zone so as to thereby apply a surface pressure to the workpieces; moving the workpieces by the pressing band along the action zone; producing a temperature in the fluid pressure medium in the action zone so as to apply the temperature to the workpiece; moving the fluid pressure medium in the action zone by moving means; and additionally to said moving, producing a turbulent flow of the fluid pressure medium in the action zone by turbulent flow producing means which is separate from said moving means so as to positively act on the fluid pressure medium and to produce the turbulent flow of the fluid pressure medium which flows through the action zone and to thereby increase a heat transfer to the workpieces.

2. A method as defined in claim 1, wherein said accommodating step includes accommodating the pressure medium which is a gaseous pressure medium, said producing step including moving the gaseous pressure medium with a speed of 2–50 m/sec.

3. A method as defined in claim 2, wherein said producing step includes moving the gaseous pressure medium with a speed of 20–40 m/sec.

4. A method as defined in claim 1, wherein said accommodating step includes accommodating the pressure medium which is a liquid pressure medium, said producing step including moving the liquid pressure medium with a speed of 4–5 m/sec.

5. A method as defined in claim 1, wherein said producing step includes producing the turbulent flow of the fluid pressure medium directly in the action zone.

6. A method as defined in claim 1, wherein said producing step includes producing the turbulent flow of the fluid pressure medium in a closed circuit which includes the action zone.

7. A method as defined in claim 1; and further comprising controlling the degree of temperature transfer from the fluid pressure medium to a workpiece and including varying a flow speed of the fluid pressure medium.

8. A method as defined in claim 1; and further comprising controlling the degree of temperature transfer from the pressure medium to a workpiece and including varying a pressure of the fluid pressure medium.

9. A method as defined in claim 1; and further comprising controlling the degree of temperature transfer from the pressure medium to a workpiece by varying a speed of the fluid pressure medium and varying pressure of the fluid pressure medium.

10. A method as defined in claim 1, wherein said producing includes producing a turbulent flow of the fluid pressure medium in the action zone by the turbulent flow producing means arranged in the action zone.

11. An arrangement for applying a surface pressure and temperature to workpieces which are driven by a pressing band, comprising means forming an action zone for accommodating a fluid pressure medium, said action zone forming means including the pressing band and a heating plate with a seal located between said pressing band and said plate; means for moving said plate; means for moving said pressing band so that the workpieces are moved by said pressing band along said action zone; means for supplying a fluid pressure medium into said action zone so that the fluid pressure medium is accommodated in said action zone under operational pressure and moving the fluid pressure medium through said action zone; means for generating a temperature in said plate; and additionally to said fluid pressure medium supplying and moving means, separate means for producing a turbulent flow of the fluid pressure medium in the action zone, so as to positively act on the fluid pressure medium and to produce the turbulent flow of the fluid pressure medium which flows through said action zone and to thereby increase a heat transfer to the workpieces.

12. An arrangement as defined in claim 11, wherein said action zone has a part with a flow cross-section which is greater than a flow cross-section of a remaining part of said action zone.

13. An arrangement as defined in claim 11, wherein said action zone is subdivided into at least two parts located one after the other and arranged so that they have different flow speeds.

14. An arrangement as defined in claim 11, wherein said means for producing a turbulent flow of the pressure medium in the action one is arranged in said action zone.

* * * * *